US010058739B2

(12) United States Patent
Hwang et al.

(10) Patent No.: US 10,058,739 B2
(45) Date of Patent: Aug. 28, 2018

(54) GOLF BALL HAVING SURFACE DIVIDED BY SMALL CIRCLES

(71) Applicant: VOLVIK INC., Chungcheongbuk-do (KR)

(72) Inventors: In Hong Hwang, Namyangju-si (KR); Kyung Ahn Moon, Seoul (KR)

(73) Assignee: VOLVIK INC., Chungcheongbuk-Do (KR)

( * ) Notice: Subject to any disclaimer, the term of this patent is extended or adjusted under 35 U.S.C. 154(b) by 11 days.

(21) Appl. No.: 15/077,079

(22) Filed: Mar. 22, 2016

(65) Prior Publication Data

US 2017/0136306 A1 May 18, 2017

(30) Foreign Application Priority Data

Nov. 13, 2015 (KR) ..... 10-2015-0159690

(51) Int. Cl.
*A63B 37/12* (2006.01)
*A63B 37/14* (2006.01)
*A63B 37/00* (2006.01)

(52) U.S. Cl.
CPC ..... *A63B 37/0006* (2013.01); *A63B 37/0009* (2013.01); *A63B 37/0021* (2013.01)

(58) Field of Classification Search
CPC ..... A63B 37/0006; A63B 37/0009
See application file for complete search history.

(56) References Cited

U.S. PATENT DOCUMENTS 4,560,168 A * 12/1985 Aoyama ..... A63B 37/0004 473/379
4,653,758 A * 3/1987 Solheim ..... A63B 37/0003 264/239
4,869,512 A * 9/1989 Nomura ..... A63B 37/0004 473/383
5,018,741 A * 5/1991 Stiefel ..... A63B 37/0004 473/379
5,078,402 A * 1/1992 Oka ..... A63B 37/0004 40/327
5,080,367 A * 1/1992 Lynch ..... A63B 37/0004 473/384
5,087,048 A * 2/1992 Sun ..... A63B 37/0004 40/327

(Continued)

FOREIGN PATENT DOCUMENTS

KR 1996-0004335 B1 4/1996
KR 10-0360310 B1 11/2002

*Primary Examiner* — Gene Kim
*Assistant Examiner* — Matthew B Stanczak
(74) *Attorney, Agent, or Firm* — Kilpatrick Townsend & Stockton LLP

(57) ABSTRACT

Provided is a golf ball having a surface divided by small circles. A surface of a sphere is divided by small circles to generate spherical polyhedrons in order to arrange dimples in the spherical polygons, instead of arranging dimples in spherical polyhedrons that are generated by dividing the surface of the sphere by great circles. According to one or more exemplary embodiments, a land surface of the golf ball, which is generated by arranging the dimples in the spherical polyhedrons, has a dimple area ratio higher than that of a spherical truncated icosahedron of which a surface is divided by great circles on which dimples are arranged. Therefore, a flight distance of the golf ball increases.

4 Claims, 7 Drawing Sheets

(56) References Cited

U.S. PATENT DOCUMENTS

| | | | | | |
|---|---|---|---|---|---|
| 5,127,655 | A * | 7/1992 | Yamada | A63B 37/0004 | 473/384 |
| 5,143,377 | A * | 9/1992 | Oka | A63B 37/0004 | 40/327 |
| 5,174,578 | A * | 12/1992 | Oka | A63B 37/0004 | 473/383 |
| 5,201,522 | A * | 4/1993 | Pocklington | A63B 37/0004 | 473/383 |
| 5,249,804 | A * | 10/1993 | Sanchez | A63B 37/0004 | 473/379 |
| 5,338,039 | A | 8/1994 | Oka et al. | | |
| 5,482,287 | A * | 1/1996 | Nesbitt | A63B 37/0004 | 473/378 |
| 6,450,902 | B1 | 9/2002 | Hwang | | |
| 6,991,564 | B2 * | 1/2006 | Sajima | A63B 37/0004 | 473/383 |
| 2002/0147058 | A1 * | 10/2002 | Winfield | A63B 37/0004 | 473/378 |
| 2003/0171167 | A1 * | 9/2003 | Kasashima | A63B 37/0004 | 473/378 |

* cited by examiner

FIG. 2

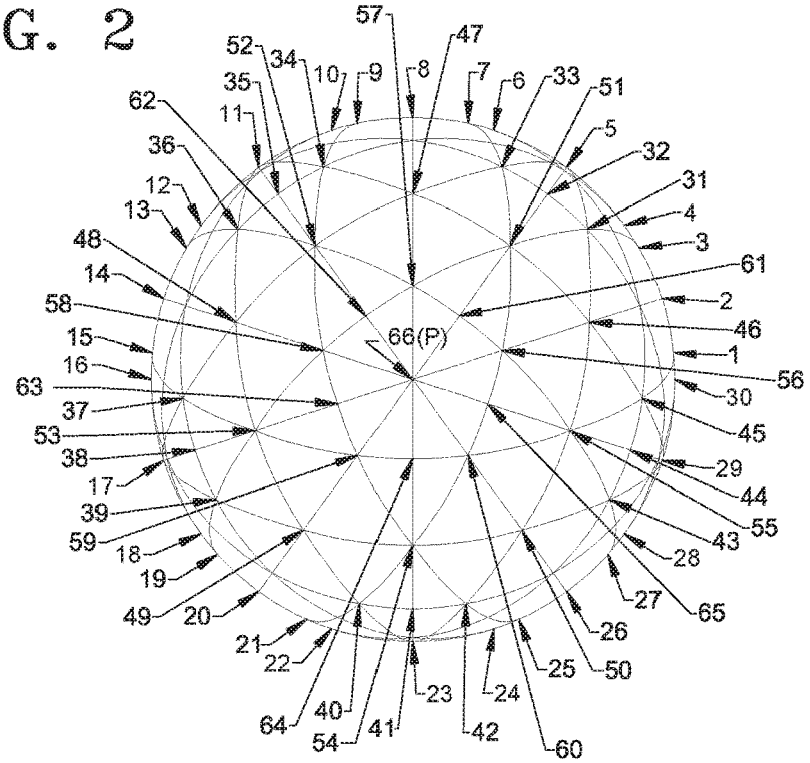

1 : La. 0°, Lo. 5.80973032°
2 : La. 0°, Lo. 18°
3 : La. 0°, Lo. 30.19026968°
4 : La. 0°, Lo. 36°
5 : La. 0°, Lo. 54°
6 : La. 0°, Lo. 72°
7 : La. 0°, Lo. 77.80973032°
8 : La. 0°, Lo. 90°
9 : La. 0°, Lo. 102.1902697°
10 : La. 0°, Lo. 108°
11 : La. 0°, Lo. 126°
12 : La. 0°, Lo. 144°
13 : La. 0°, Lo. 149.8097303°
14 : La. 0°, Lo. 162°
15 : La. 0°, Lo. 174.1902697°
16 : La. 0°, Lo. 180°
17 : La. 0°, Lo. 198°
18 : La. 0°, Lo. 216°
19 : La. 0°, Lo. 221.8097303°
20 : La. 0°, Lo. 234°
21 : La. 0°, Lo. 246.1902697°
22 : La. 0°, Lo. 252°
23 : La. 0°, Lo. 270°
24 : La. 0°, Lo. 288°
25 : La. 0°, Lo. 293.8097303°
26 : La. 0°, Lo. 306°
27 : La. 0°, Lo. 318.1902697°
28 : La. 0°, Lo. 324°
29 : La. 0°, Lo. 342°
30 : La. 0°, Lo. 0°
31 : La. 28.35345483°, Lo. 40.67152°
32 : La. 29.012167742°, Lo. 54°
33 : La. 28.35345483°, Lo. 67.32848°
34 : La. 28.35345483°, Lo. 112.67152°
35 : La. 29.012167742°, Lo. 126°
36 : La. 28.35345483°, Lo.139.32848°
37 : La. 28.35345483°, Lo. 184.67152°
38 : La. 29.012167742°, Lo. 198°
39 : La. 28.35345483°, Lo. 211.32848°
40 : La. 28.35345483°, Lo. 256.67152°
41 : La. 29.012167742°, Lo. 270°
42 : La. 28.35345483°, Lo. 283.32848°
43 : La. 28.35345483°, Lo. 328.67152°
44 : La. 29.012167742°, Lo. 342°
45 : La. 28.35345483°, Lo. 355.32848°
46 : La. 44.80225°, Lo. 18°
47 : La. 44.80225°, Lo. 90°
48 : La. 44.80225°, Lo. 162°
49 : La. 44.80225°, Lo. 234°
50 : La. 44.80225°, Lo. 306°
51 : La. 50.83302265°, Lo. 54°
52 : La. 50.83302265°, Lo. 126°
53 : La. 50.83302265°, Lo. 198°
54 : La. 50.83302265°, Lo. 270°
55 : La. 50.83302265°, Lo. 342°
56 : La. 68.95139°, Lo. 18°
57 : La. 68.95139°, Lo. 90°
58 : La. 68.95139°, Lo.162°
59 : La. 68.95139°, Lo. 234°
60 : La. 68.95139°, Lo. 306°
61 : La. 72.43739°, Lo. 54°
62 : La. 72.43739°, Lo. 126°
63 : La. 72.43739°, Lo. 198°
64 : La. 72.43739°, Lo. 270°
65 : La. 72.43739°, Lo. 342°
66 : P (La. 90°, Lo. 90°)

Position

| | |
|---|---|
| 9 : La. 0°, Lo. 102.1902697° | 13 : La. 0°, Lo. 149.8097303° |
| 15 : La. 0°, Lo. 174.1902697° | 31 : La. 28.35345483°, Lo. 40.67152° |
| 32 : La. 29.012167742 °, Lo. 54° | 33 : La. 28.35345483°, Lo. 67.32848° |
| 34 : La. 28.35345483°, Lo. 112.67152° | 35 : La. 29.012167742°, Lo. 126° |
| 36 : La. 28.35345483°, Lo.139.32848° | 37 : La. 28.35345483°, Lo. 184.67152° |
| 46 : La. 44.80225°, Lo. 18° | 47 : La. 44.80225°, Lo. 90° |
| 48 : La. 44.80225°, Lo. 162° | 51 : La. 50.83302265°, Lo. 54° |
| 56 : La. 68.95139°, Lo. 18° | 57 : La. 68.95139°, Lo. 90° |
| 61 : La. 72.43739°, Lo. 54° | 66 : P (La. 90°, Lo. 90°) |

Interior Angle

| | | |
|---|---|---|
| A : 111.8348301° | B : 124.0825849° | C : 124.741408° |
| D : 125.0740312° | E : 110.517184° | F : 117.2230803° |
| G : 108.6287914° | H : 117.7028885° | I : 71.37120855° |

Degree Distance

| | | |
|---|---|---|
| a : 24.3746864° | b : 21.04861° | c : 17.56261° |
| d1 : 24.14914° | d2 : 24.38053908° | d3 : 23.41054723° |
| e : 21.6043673° | f : 49.29809085° | g : 43.42522226° |
| h1 : 24.38053908° | h2 : 30.0772096° | h3 : 24.38053935° |
| i : 44.80225° | j : 23.41054723° | k : 30.0772096° |
| l : 47.61946064° | m : 29.01216774° | |

FIG. 4

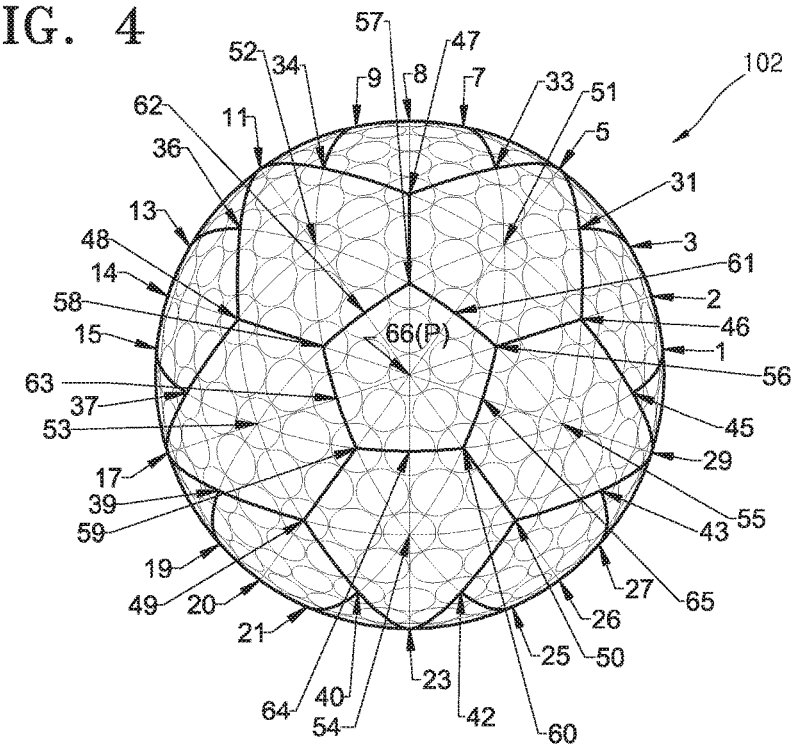

1 : La. 0°, Lo. 5.80973032°
2 : La. 0°, Lo. 18°
3 : La. 0°, Lo. 30.19026968°
5 : La. 0°, Lo. 54°
7 : La. 0°, Lo. 77.80973032°
8 : La. 0°, Lo. 90°
9 : La. 0°, Lo. 102.1902697°
11 : La. 0°, Lo. 126°
13 : La. 0°, Lo. 149.8097303°
14 : La. 0°, Lo. 162°
15 : La. 0°, Lo. 174.1902697°
17 : La. 0°, Lo. 198°
19 : La. 0°, Lo. 221.8097303°
20 : La. 0°, Lo. 234°
21 : La. 0°, Lo. 246.1902697°
23 : La. 0°, Lo. 270°
25 : La. 0°, Lo. 293.8097303°
26 : La. 0°, Lo. 306°
27 : La. 0°, Lo. 318.1902697°
29 : La. 0°, Lo. 342°
31 : La. 28.35345483°, Lo. 40.67152°
33 : La. 28.35345483°, Lo. 67.32848°
34 : La. 28.35345483°, Lo. 112.67152°
36 : La. 28.35345483°, Lo.139.32848°
37 : La. 28.35345483°, Lo. 184.67152°
39 : La. 28.35345483°, Lo. 211.32848°
40 : La. 28.35345483°, Lo. 256.67152°
42 : La. 28.35345483°, Lo. 283.32848°
43 : La. 28.35345483°, Lo. 328.67152°
45 : La. 28.35345483°, Lo. 355.32848°
46 : La. 44.80225°, Lo. 18°
47 : La. 44.80225°, Lo. 90°
48 : La. 44.80225°, Lo. 162°
49 : La. 44.80225°, Lo. 234°
50 : La. 44.80225°, Lo. 306°
51 : La. 50.83302265°, Lo. 54°
52 : La. 50.83302265°, Lo. 126°
53 : La. 50.83302265°, Lo. 198°
54 : La. 50.83302265°, Lo. 270°
55 : La. 50.83302265°, Lo. 342°
56 : La. 68.95139°, Lo. 18°
57 : La. 68.95139°, Lo. 90°
58 : La. 68.95139°, Lo.162 °
59 : La. 68.95139°, Lo. 234°
60 : La. 68.95139°, Lo. 306°
61 : La. 72.43739°, Lo. 54°
62 : La. 72.43739°, Lo. 126°
63 : La. 72.43739°, Lo. 198°
64 : La. 72.43739°, Lo. 270°
65 : La. 72.43739°, Lo. 342°
66 : P (La. 90°, Lo. 90°)

Position

| | |
|---|---|
| 71 : La. 0°, Lo. 108° | 72 : La. 0°, Lo. 126° |
| 73 : La. 0°, Lo. 144° | 74 : La. 9.883145528°, Lo. 173.8185857° |
| 75 : La. 10.09284045°, Lo. 162° | 76 : La. 9.883145528°, Lo. 150.18141426° |
| 77 : La. 9.883145528°, Lo. 101.8185857° | 78 : La. 30.99196881°, Lo. 184.3861776° |
| 79 : La. 30.99196881°, Lo. 139.61382243° | 80 : La. 31.71747444°, Lo. 126° |
| 81 : La. 30.99196881°, Lo. 112.3861776° | 82 : La. 30.99196881°, Lo. 67.61382243° |
| 83 : La. 31.71747444°, Lo. 54° | 84 : La. 30.99196881°, Lo. 40.38617757° |
| 85 : La. 46.64180242°, Lo. 18° | 86 : La. 46.64180242°, Lo. 90° |
| 87 : La. 46.64180242°, Lo. 162° | 88 : La. 52.62263186°, Lo. 54° |
| 89 : La. 69.92324873°, Lo. 90° | 90 : La. 69.92324873°, Lo. 18° |
| 91 : La. 73.52778931°, Lo. 54° | 96(CP) : La. 90°, Lo. 90° |

Interior Angle

| | | |
|---|---|---|
| Q : 111.3812791° | R : 124.3093605° | S : 124.3093605° |
| T : 124.3093605° | U : 111.3812791° | V : 111.3812791° |
| W : 111.3812791° | X : 124.3093605° | Y : 124.3093605° |
| Z : 124.3093605° | | |

Degree Distance

| | | |
|---|---|---|
| q : 23.28144627° | r : 20.07675127° | s : 16.47221069° |
| t : 23.28144627° | u : 20.90515745° | v : 47.6003652° |
| w : 41.8103149° | x1 : 23.28144627° | x2 : 23.28144627° |
| x3 : 23.28144627° | y : 23.28144627° | |

GOLF BALL HAVING SURFACE DIVIDED BY SMALL CIRCLES

CROSS-REFERENCE TO RELATED APPLICATION

This application claims the benefit of Korean Patent Application No. 10-2015-0159690, filed on Nov. 13, 2015, in the Korean Intellectual Property Office, the disclosure of which is incorporated herein in its entirety by reference.

BACKGROUND

1. Field

One or more exemplary embodiments relate to a golf ball, and more particularly, to a golf ball having divided spherical surfaces in order to effectively arrange dimples thereon.

2. Description of the Related Art

In order to arrange dimples on a surface of a golf ball, the surface of a sphere is generally divided by the great circles into a spherical polyhedron having a plurality of spherical polygons. A great circle is formed by an intersection of the surface of the sphere with a plane passing through a central point of the sphere. A small circle is a circle drawn on the surface of the sphere, other than the great circle.

The dimples are arranged on the spherical polyhedron in such a manner that the dimples have spherical symmetry. Most spherical polyhedrons that are frequently used to arrange dimples of a golf ball include spherical regular polygons. Examples of the spherical regular polyhedrons may be a spherical tetrahedron having four spherical regular triangles, a spherical hexahedron having six spherical squares, a spherical octahedron having eight spherical regular triangles, a spherical dodecahedron having twelve regular pentagons, a spherical icosahedron having twenty spherical regular triangles, a spherical cubeoctahedron having six spherical squares and eight spherical regular triangles, an icosidodecahedron having twenty spherical regular triangles and twelve spherical regular pentagons, or the like.

On existing golf balls, three to four hundred dimples are symmetrically arranged on a spherical polyhedron having spherical polygons formed by dividing the surface of the sphere by the great circles only. When a mold cavity is manufactured with two to four types of diameters of the dimples, the land surfaces on which the dimples are not arranged increases. When the area of the land surface becomes relatively larger, a lift force regarding flight of the golf ball is affected, and thus, a flight distance of the golf ball is reduced. Therefore, in order to solve such a problem, various types of dimples having very small diameters are arranged on a golf ball to reduce the area of the land surface as small as possible.

U.S. Pat. No. 4,560,168 discloses an example of the surface of a golf ball which is divided by the great circles. On the golf ball, each of the triangles of a regular icosahedron is divided into four triangles by six great circles, to thus form twenty small triangles and twelve pentagons, that is, a spherical icosidodecahedron, where the dimples are arranged.

However, conventionally, more types of dimples are needed overall. Accordingly, it's costing too much to make a mold cavity. Also, the appearance of the golf ball is aesthetically poor.

Furthermore, in the case of a spherical polyhedron including at least two types of spherical regular polygons, the diameters of dimples vary with the types of the spherical regular polygon, which make a difference in the air flow, and thus the flight performance of the golf ball may be changed.

FIGS. 5 and 6 show a golf ball 200 of the related art. The golf ball 200 has a spherical truncated icosahedral surface obtained by dividing a spherical icosahedron by the great circles. The spherical truncated icosahedron may be obtained by dividing a surface of a sphere by the great circles into a spherical icosahedron including spherical regular triangles and then cutting off vertex portions of each spherical regular triangle, and the spherical truncated icosahedron includes twelve spherical regular pentagons and twenty spherical regular hexagons. The spherical truncated icosahedron is well known as a spherical polyhedron that has been mainly used to produce a soccer ball, but the spherical truncated icosahedron has also been used as a surface segmental structure that is adapted to arrange the dimples of a golf ball. However, when the dimples having the sizes greater than a certain size are arranged on the surface of the golf ball which divided into the spherical truncated icosahedrons, the land surfaces on which the dimples are not arranged is considerably formed.

RELATED ART

Patent Document

U.S. Pat. No. 4,560,168

SUMMARY

One or more exemplary embodiments include a golf ball having a dimple area ratio that increases by reducing the land surfaces.

Additional aspects will be set forth in part in the description which follows and, in part, will be apparent from the description, or may be learned by practice of the presented embodiments.

Unlike an existing golf ball of which the surface is divided by great circles, the present disclosure features a surface of a golf ball divided by small circles into symmetrical spherical polygons where dimples are arranged.

Also, spherical polygons near the equator are further divided by great circles, and then, dimples are arranged to have bilateral symmetry on the divided spherical polygons.

In addition, a spherical polyhedron that is divided by small circles as well as great circles may include a spherical regular pentagon, a spherical regular hexagon, a spherical trapezoid, and other spherical pentagons.

BRIEF DESCRIPTION OF THE DRAWINGS

These and/or other aspects will become apparent and more readily appreciated from the following description of the embodiments, taken in conjunction with the accompanying drawings in which:

FIG. 2 shows the latitudes and longitudes of the locations which small circles are passing through the points that dividing a surface of a sphere and also shows the latitudes and longitudes of locations where spherical polygons near the equator are further divided by great circles;

FIG. 4 is a diagram of a golf ball according to another exemplary embodiment, wherein a surface of a golf ball on which dimples are arranged is viewed from a pole, the latitudes and longitudes of the main locations, which small circles are passing through the points that dividing a surface of a sphere, are shown, dimples are arranged on the spherical polygons formed on the surface of the sphere which is divided by small circles, and the latitudes and longitudes of the locations, which the small circles are passing through the points that dividing the surface of the sphere, are shown at the bottom;

DETAILED DESCRIPTION

As described above, it was difficult to symmetrically arrange the dimples having similar diameters due to fixed sizes of spherical regular pentagons and spherical regular hexagons included in a spherical truncated icosahedron, by cutting off vertex portions of each spherical triangle forming an existing spherical icosahedron that is formed by dividing a surface of a sphere by existing great circles.

Thus, in order to solve such problem, the disclosure provides a method of symmetrically dividing a sphere by small circles instead of dividing the sphere by great circles.

Figure 1:
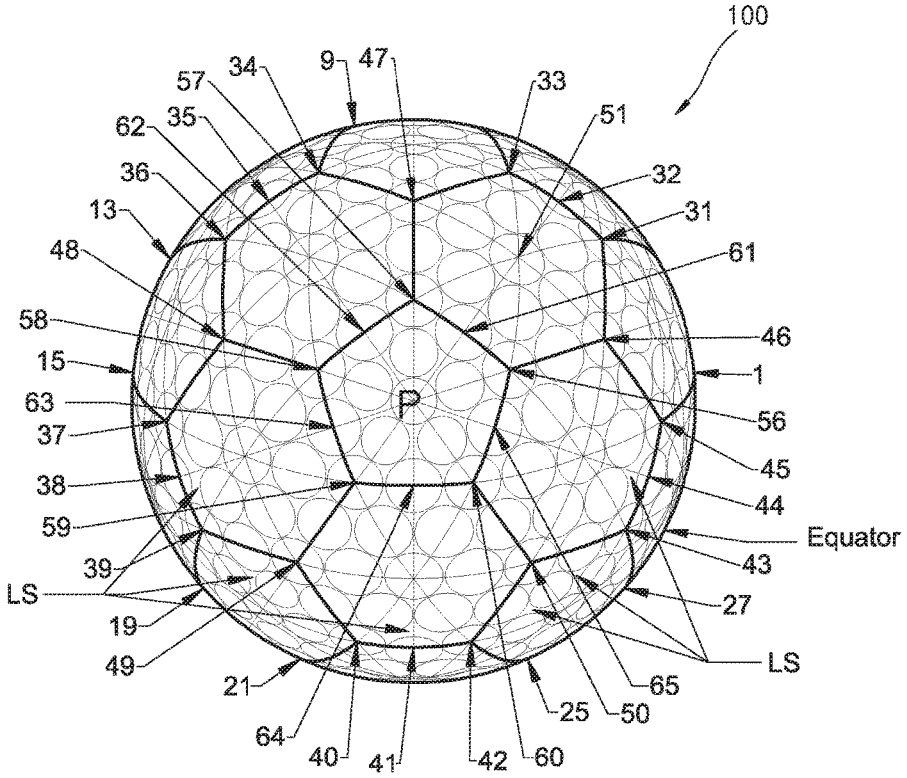
FIG. 1 is a diagram of a golf ball according to an exemplary embodiment, wherein a surface of a golf ball on which dimples are arranged is viewed from a pole, the latitudes and longitudes of major locations which small circles are passing through the points that dividing the surface of a sphere, are shown, the dimples are arranged on the spherical polygons, which are formed by dividing the surface of the sphere by the small circles, and on spherical polygons, which are formed by further dividing the spherical polygons near the equator by great circles, the golf ball has the land surface LS (on which dimples are not arranged) that is smaller than the land surfaces formed on a surface of an existing golf ball that is divided by great circles, and numbers on FIG. 1 indicate points, for example, '9' means the 'point 9', which is the same as in the other following drawings.

FIG. 1 is a diagram of a golf ball 100 according to an exemplary embodiment.

In the present exemplary embodiment, dimples are arranged on a spherical polyhedron that is obtained by dividing a surface of a sphere by small circles and further dividing portions of the surface, which are near the equator, by great circles. Identical dimples are arranged on the identical spherical polygons. The spherical polygons include two spherical regular pentagons, ten spherical hexagons, ten spherical trapezoids, and ten spherical pentagons.

Referring to FIG. 2, when an arbitrary point on the surface of the sphere is considered as a pole, in order to make spherical polygons, the surface of the sphere is divided by; small circles passing through the point 1 (latitude 0° and longitude 5.80973032°), the point 45 (latitude 28.35345483° and longitude 355.32848°), the point 55 (latitude 50.83302265° and longitude 342°), the point 60 (latitude 68.95139° and longitude 306°), the point 59 (latitude 68.95139° and longitude 234°), the point 53 (latitude 50.83302265° and longitude 198°), the point 37 (latitude 28.35345483° and longitude 184.67152°), and the point 15 (latitude 0° and longitude 174.1902697°); small circles passing through the point 3 (latitude 0° and longitude 30.19026968°), the point 31 (latitude 28.35345483° and longitude 40.67152°), the point 51 (latitude 50.83302265° and longitude 54°), the point 57 (latitude 68.95139° and longitude 90°), the point 58 (latitude 68.95139° and longitude 162°), the point 53 (latitude 50.83302265° and longitude 198°), the point 39 (latitude 28.35345483° and longitude 211.32848°), and the point 19 (latitude 0° and longitude 221.8097303°); small circles passing through the point 7 (latitude 0° and longitude 77.80973032°), the point 33 (latitude 28.35345483° and longitude 67.32848°), the point 51 (latitude 50.83302265° and longitude 54°), the point 56 (latitude 68.95139° and longitude 18°), the point 60 (latitude 68.95139° and longitude 306°), the point 54 (latitude 50.83302265° and longitude 270°), the point 40 (latitude 28.35345483° and longitude 256.67152°), and the point 21 (latitude 0° and longitude 246.1902697°); small circles passing through the point 9 (latitude 0° and longitude 102.1902697°), the point 34 (latitude 28.35345483° and longitude 112.67152°), the point 52 (latitude 50.83302265° and longitude 126°), the point 58 (latitude 68.95139° and longitude 162°), the point 59 (latitude 68.95139° and longitude 234°), the point 54 (latitude 50.83302265° and longitude 270°), the point 42 (latitude 28.35345483° and longitude 283.32848°), and the point 25 (latitude 0° and longitude 293.8097303°); small circles passing through the point 13 (latitude 0° and longitude 149.8097303°), the point 36 (latitude 28.35345483° and longitude 139.32848°), the point 52 (latitude 50.83302265° and longitude 126°), the point 57 (latitude 68.95139° and longitude 90°), the point 56 (latitude 68.95139° and longitude 18°), the point 55 (latitude 50.83302265° and longitude 342°), the point 43 (latitude 28.35345483° and longitude 328.67152°), and the point 27 (latitude 0° and longitude 318.1902697°); small circles passing through the point 5 (latitude 0° and longitude 54°), the point 33 (latitude 28.35345483° and longitude 67.32848°), the point 47 (latitude 44.80225° and longitude 90°), the point 52 (latitude 50.83302265° and longitude 126°), the point 48 (latitude 44.80225° and longitude 162°), the point 37 (latitude 28.35345483° and longitude 184.67152°), and the point 17 (latitude 0° and longitude 198°); small circles passing through the point 5 (latitude 0° and longitude 54°), the point 31 (latitude 28.35345483° and longitude 40.67152°), the point 46 (latitude 44.80225° and longitude 18°), the point 55 (latitude 50.83302265° and longitude 342°), the point 50 (latitude 44.80225° and longitude 306°), the point 42 (latitude 28.35345483° and longitude 283.32848°), and the point 23 (latitude 0° and longitude 270°); small circles passing through the point 11 (latitude 0° and longitude 126°), the point 36 (latitude 28.35345483° and longitude 139.32848°), the point 48 (latitude 44.80225° and longitude 162°), the point 53 (latitude 50.83302265° and longitude 198°), the point 49 (latitude 44.80225° and longitude 234°), the point 40 (latitude 28.35345483° and longitude 256.67152°), and the point 23 (latitude 0° and longitude 270°); small circles passing through the point 11 (latitude 0° and longitude 126°), the point 34 (latitude 28.35345483° and longitude 112.67152°), the point 47 (latitude 44.80225° and longitude 90°), the point 51 (latitude 50.83302265° and longitude 54°), the point 46 (latitude 44.80225° and longitude 18°), the point 45 (latitude 28.35345483° and longitude 355.32848°), and a point 29 (latitude 0° and longitude 342°); and small circles passing through the point 17 (latitude 0° and longitude 198°), the point 39 (latitude 28.35345483° and longitude 211.32848°), the point 49 (latitude 44.80225° and longitude 234°), the point 54 (latitude 50.83302265° and longitude 270°), the point 50 (latitude 44.80225° and longitude 306°), the point 43 (latitude 28.35345483° and longitude 328.67152°), and the point 29 (latitude 0° and longitude 342°).

In the present exemplary embodiment, through the following method, a desired spherical polyhedron is obtained by further dividing some of the spherical polygons near the equator by the great circles.

The spherical polygons near the equator are further divided by the line segment of a great circle passing through the point 4 (latitude 0° and longitude 36°), the point 35 (latitude 29.012167742° and longitude 126°), and the point 18 (latitude 0° and longitude 216°), the line segment of a great circle passing through the point 12 (latitude 0° and longitude 144°), the point 32 (latitude 29.012167742° and longitude 54°), and the point 28 (latitude 0° and longitude 324°), the line segment of a great circle passing through the point 10 (latitude 0° and longitude 108°), the point 38 (latitude 29.012167742° and longitude 198°), and the point 24 (latitude 0° and longitude 288°), the line segment of a great circle passing through the point 16 (latitude 0° and longitude 180°), the point 41 (latitude 29.012167742° and longitude 270°), and the point 30 (latitude 0° and longitude 0°), and the line segment of a great circle passing through the point 22 (latitude 0° and longitude 252°), the point 44 (latitude 29.012167742° and longitude 342°), and the point 6 (latitude 0° and longitude 72°). The surface of the sphere is further divided by the connected line segment passing through the point 2 (latitude 0° and longitude 18°), the point 8 (latitude 0° and longitude 90°), the point 14 (latitude 0° and longitude 162°), the point 20 (latitude 0° and longitude 234°), and the point 26 (latitude 0° and longitude 306°), and this line segment is used as the equator.

Figure 3:
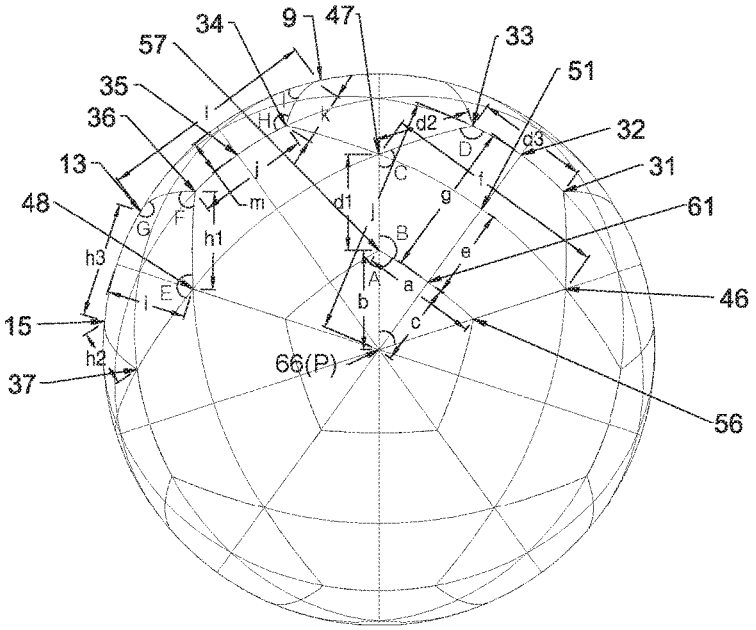
FIG. 3 shows the latitudes and a longitudes of the major locations of a representative spherical polygon among spherical polygons that are symmetrical to each other in order to arrange dimples on the surface of the sphere of FIG. 2 having a segmental structure and shows internal angles of vertices and lengths of sides of representative ones of the spherical polygons in order to present a size of each spherical polygon, wherein the internal angles and the lengths are represented as angles under a condition that a circumference of the sphere is 360 degrees.

And then the dimples are arranged on the spherical polygons. FIG. 3 shows the shapes of main spherical polygons that necessary to arrange the dimples thereon, the main spherical polygons being selected from among the spherical polygons of FIG. 2 which are generated by the line segments of the small circles and the line segments of the great circles. When a circumference of the sphere is 360 degrees, the size of an internal angle, the position of a vertex, and the length of a side, etc. of each spherical polygon are presented as angles, so easily determined the size, the number of the dimples etc.

According to exemplary embodiments, dimples may be arranged on the spherical polygons generated by dividing a surface of a sphere by small circles only. A golf ball 102 of FIG. 4 is one of the exemplary embodiments and will be described later.

In the specification, the term 'line segment' does not mean a straight line in mathematics which connects two points to each other, but means a line that connects two points to each other on a surface of a sphere. For example, the term 'line segment of a small circle' denotes a line that connects two points to each other on a small circle, and the term 'line segment of a great circle' denotes a line that connects two points to each other on a great circle.

As shown in FIG. 3, line segments that connect the point 56 (latitude 68.95139° and longitude 18°), the point 61 (latitude 72.43739° and longitude 54°), and the point 57 (latitude 68.95139° and longitude 90°) are used as a side of a spherical regular pentagon having the pole at a center of the regular pentagon. And other sides of the spherical regular pentagon have the same size as the above side. An internal angle A of a vertex of the spherical regular pentagon is 111.8348301°. Also, when the circumference of the sphere is 360 degrees, an angular length of a side a is 24.3746864 degrees.

In the specification, the term 'angular length' is a unit of a length. The length of a circumference is 360 degrees, and a length of the smallest line that connects two points to each other on the surface of the sphere is a central angle. For example, the length of the circumference is 360 degrees, and a length of the smallest line from the equator to the pole is 90 degrees.

The spherical regular pentagon has equal sides and equal internal angles. As shown in FIG. 3, when the circumference of the sphere is 360 degrees, a height length of the spherical regular pentagon is 38.61122 degrees, which are the sum of b and c, that is, the sum of 21.04861 degrees and 17.56261 degrees. Two spherical regular pentagons produced based on the North pole and the South pole.

Also, FIG. 3 shows spherical hexagons that share one side with the spherical regular pentagon having the pole at the center thereof from among the spherical polygons that are generated by further dividing the surface of the sphere by the great circles as described above. A representative one of the spherical hexagons is presented. The representative spherical hexagon has, as sides, line segments that connect the point 57 (latitude 68.95139° and longitude 90°), the point 56 (latitude 68.95139° and longitude 18°), the point 46 (latitude 44.80225° and longitude 18°), the point 31 (latitude 28.35345483° and longitude 40.67152°), the point 33 (latitude 28.35345483° and longitude 67.32848°), the point 47 (latitude 44.80225° and longitude 90°), and the point 57 (latitude 68.95139° and longitude 90°). The internal angle B of a vertex at which the spherical hexagon and the spherical pentagon near the pole share the same side is 124.0825849°. Internal angles, which face each other on a same side with respect to a line segment dividing the spherical hexagon in half from the pole to the equator, are the same as each other.

Also, the internal angle C of another vertex of the spherical hexagon is 124.741408 degrees, and an internal angle that faces the internal angle C is the same. The internal angle D of a vertex of a base side of the spherical hexagon which is near the equator is 125.0740312 degrees, and internal angles, which face each other on a same side with respect to the line segment dividing the spherical hexagon in half from the pole to the equator, are the same as each other.

When the circumference of the sphere is 360 degrees, each length of the side and the height of the spherical hexagon, is represented as an angular length as follows.

The length a of a topside of the spherical hexagon near the pole is an angular length of 24.3746864 degrees because the length a is the same length as the side of the spherical pentagon which is near the pole. The length d1 of an upper side connected to the topside is an angular length of 24.14914 degrees. Angular lengths of sides, which face each other on a same side with respect to the line segment dividing the spherical hexagon in half from the pole to the equator, are the same as each other. The length d2 of a lower side connected to the upper side is an angular length of 24.38053908 degrees, and angular lengths of sides, which face each other on a same side with respect to the line segment dividing the spherical hexagon in half from the pole to the equator, are the same as each other. The length d3 of the base side of the spherical hexagon is an angular length of 23.41054723 degrees. The height length g between the base side and the topside of the spherical hexagon is an angular length of 43.42522226 degrees, and the length f of a line segment that connects a vertex, the point 47 (latitude 44.80225° and longitude 90°) to a vertex, the point 46 (latitude 44.80225° and longitude 18°), that is, the length f of the line segment perpendicular to the height, is an angular length of 49.29809085 degrees.

FIG. 3 shows spherical pentagons that share one side with the spherical hexagon and share base sides with the equator. Among the spherical pentagons, a representative spherical pentagon uses as the sides, the line segments that connecting the point 48 (latitude 44.80225° and longitude 162°), the point 36 (latitude 28.35345483° and longitude 139.32848°), the point 13 (latitude 0° and longitude 149.8097303°), the point 15 (latitude 0° and longitude 174.1902697°), the point 37 (latitude 28.35345483° and longitude 184.67152°), and the point 48 (latitude 44.80225° and longitude 162°). The internal angle E of a vertex at which a side is shared by the spherical pentagon and the spherical hexagon is 110.517184 degrees, and the internal angle F of a vertex formed by a roof side and a pillar side of the spherical pentagon near the equator is 117.2230803 degrees. Internal angles, which face each other on a same side with respect to a line segment dividing the spherical pentagon in half from the pole to the equator, are the same as each other. The internal angle G of a vertex formed by the pillar side and the base side of the spherical pentagon near the equator is 108.6287914 degrees, and internal angles, which face each other on the same side with respect to a line segment dividing the spherical pentagon in half from the pole to the equator, are the same as each other.

When the circumference of the sphere is 360 degrees, each length of the side and the height of the spherical pentagon near the equator are represented as an angular lengths as below.

The length h1 of the roof side of the spherical pentagon near the equator is an angular length of 24.38053908 degrees because the length h1 is the same as the length d2 of the side of the spherical hexagon, and an angular length of a roof side that is opposite to the above roof side based on the line segment dividing the spherical hexagon in half from the pole to the equator, are the same as each other. A length h2 of a pillar side connected to the roof side is an angular length of 30.0772096 degrees, and a side opposite to the pillar side based on the line segment has an angular length that is the same as the length h2. The length h3 of a base side of the spherical pentagon near the equator is an angular length of 24.38053935 degrees. Also, the height length i of the spherical pentagon near the equator is an angular length of 44.80225 degrees.

FIG. 3 shows spherical trapezoids that share the base side and one side with the spherical hexagon. Among the spherical trapezoids, a representative spherical trapezoid uses as the sides, the line segments that connect the point 34 (latitude 28.35345483° and longitude 112.67152°), the point 36 (latitude 28.35345483° and longitude 139.32848°), the point 13 (latitude 0° and longitude 149.8097303°), the point 9 (latitude 0° and longitude 102.1902697°), and the point 34 (latitude 28.35345483° and longitude 112.67152°). The internal angle H of a vertex formed by a side and a topside of the spherical trapezoid is 117.7028885 degrees, and internal angles, which face each other on the same side with respect to a line segment dividing the spherical trapezoid in half from the pole to the equator, are the same as each other. The internal angle I of a vertex formed by a side and a base side of the spherical trapezoid near the equator is 71.37120855 degrees, and internal angles, which face each other on the same side with respect to the line segment dividing the spherical trapezoid in half from the pole to the equator, are the same as each other.

When the circumference of the sphere is 360 degrees, each length of the side and the height, of the spherical trapezoid near the equator are represented as an angle length as follows.

The length j of the topside of the spherical trapezoid near the equator is an angle length of 23.41054723 degrees because the length j is the same as the length d3 of the base side of the spherical hexagon, and the length k of a side connected to the topside is an angular length of 30.0772096 degrees which is the same as the length h2 because the side is shared by the pillar side of the pentagon near the equator. Angular lengths of sides, which face each other on the same side with respect to the line segment dividing the spherical trapezoid in half from the pole to the equator, are the same as each other. The length l of the base side of the spherical trapezoid which is near the equator side is an angular length of 47.61946064 degrees, and the height length m of the spherical trapezoid near the equator is an angular length of 29.01216774 degrees.

The spherical polygons obtained above are two spherical regular pentagons, ten spherical hexagons, ten spherical trapezoids, and ten spherical pentagons, and the spherical surface is divided by the spherical polygons to arranged dimples thereon. When the dimples are arranged as shown in FIG. 1, smaller numbers of land surface LS, on which the dimples are not arranged, exist, and thus, a dimple area ratio may be increased.

Figure 5:
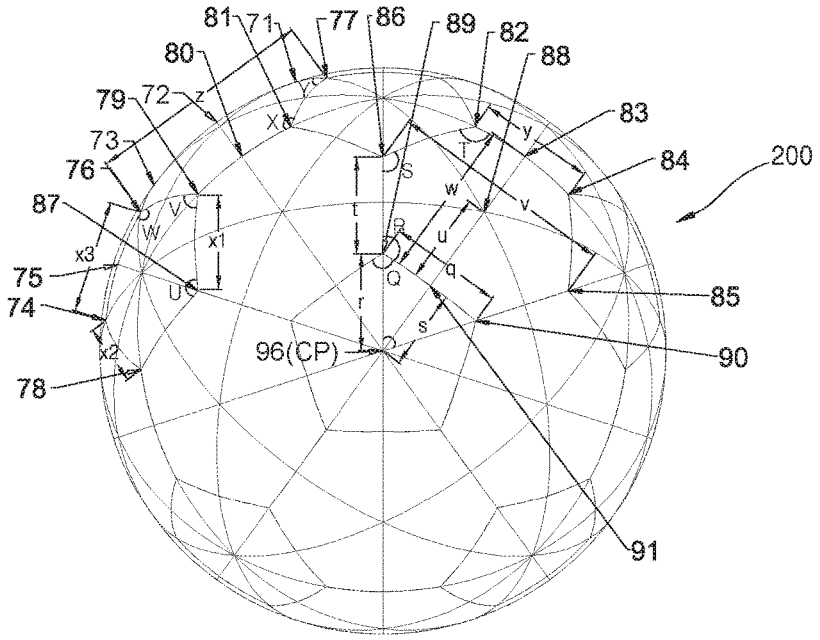
FIG. 5 is a diagram of a comparative example of a golf ball which shows a difference between the presented golf ball and an existing golf ball, shows the latitudes and longitudes of the main locations of representative spherical polygons among the spherical regular pentagons and spherical regular hexagons which form a spherical truncated icosahedron, which is formed by cutting off vertex portions of each spherical triangle forming a spherical icosahedron that is formed by dividing a surface of a sphere by existing great circles, and shows internal angles of vertices and lengths of sides of the representative spherical polygons respectively, wherein the internal angles and the lengths are represented as angles under a condition that a circumference of the sphere is 360 degrees.

As a comparative example, a spherical truncated icosahedron, which is obtained by dividing the surface of the sphere by the great circles to form a spherical icosahedron and cutting off vertex portions of each spherical triangle forming the spherical icosahedron, is shown in FIG. 5 that may be compared with FIG. 3 that shows the internal angles, lengths, etc. of vertices of the spherical polygons. A spherical regular pentagon having the pole at the center thereof has, as a side, a line segment that connects the point 89 (latitude 69.92324873° and longitude 90°), the point 91 (latitude 73.52778931° and longitude 54°), and the point 90 (latitude 69.92324873° and longitude 18°), and also has other sides having the same size. The internal angle Q of a vertex of the spherical regular pentagon is 111.3812791°. Also, when the circumference of the sphere is 360 degrees, the one side length q is an angular length of 23.28144627 degrees. The spherical regular pentagon has equal sides and equal internal angles. As shown in FIG. 5, when the circumference of the sphere is 360 degrees, the height length of the spherical regular pentagon is 36.54896197 degrees, which are the sum of r and s, that is, the sum of 20.07675127 degrees and 16.47221069 degrees. Two spherical regular pentagons produced based on the North pole and the South pole.

Figure 6:
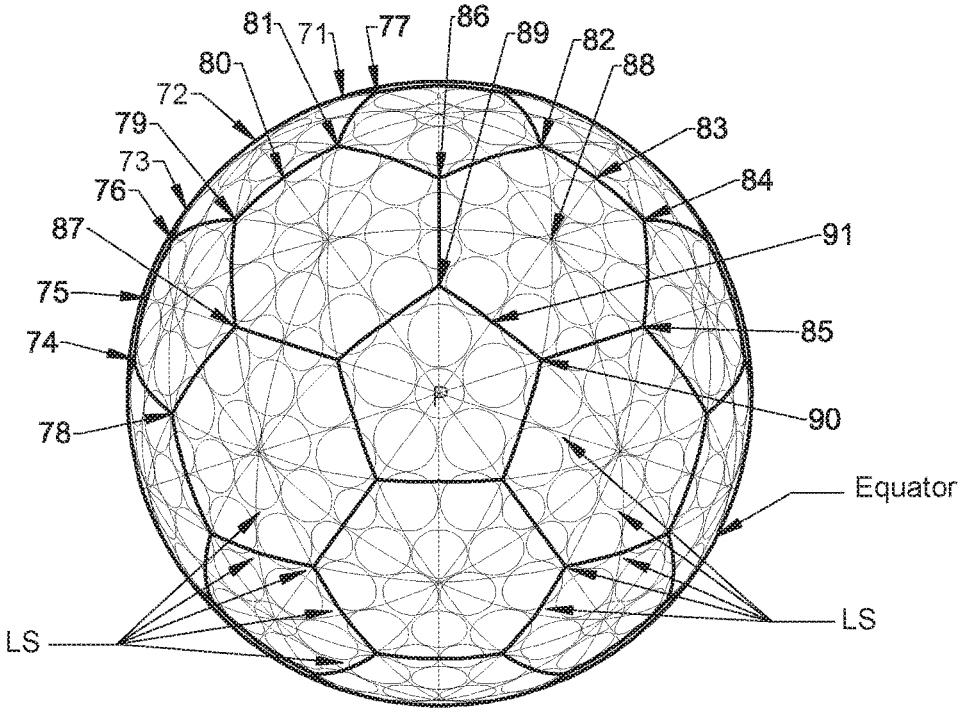
FIG. 6 is a comparative example, wherein a surface of a golf ball that is a spherical truncated icosahedron on which dimples are arranged is viewed from a pole, and shows the latitudes and longitudes of the main locations of representative spherical polygons among the spherical regular pentagons and spherical regular hexagons which form the spherical truncated icosahedron, and shows a large number of land surfaces (on which dimples are not arranged).
Figure 7:
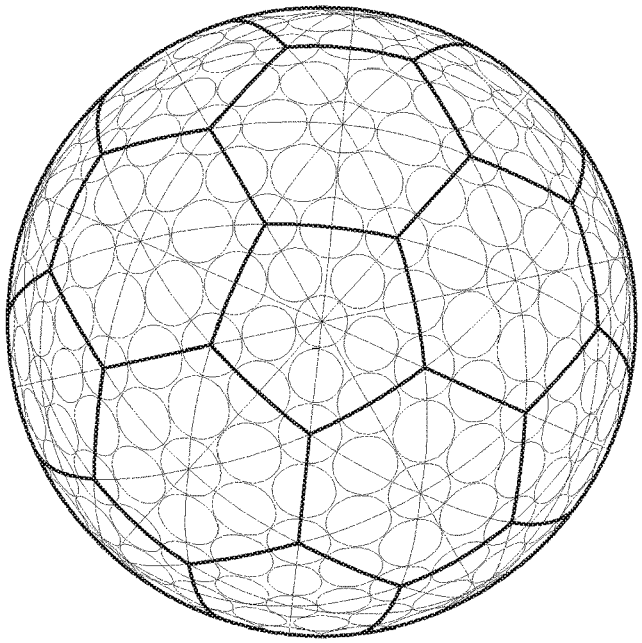
FIG. 7 shows a an opposite side view of the golf ball 100 illustrated in FIG. 1.
Figure 8:
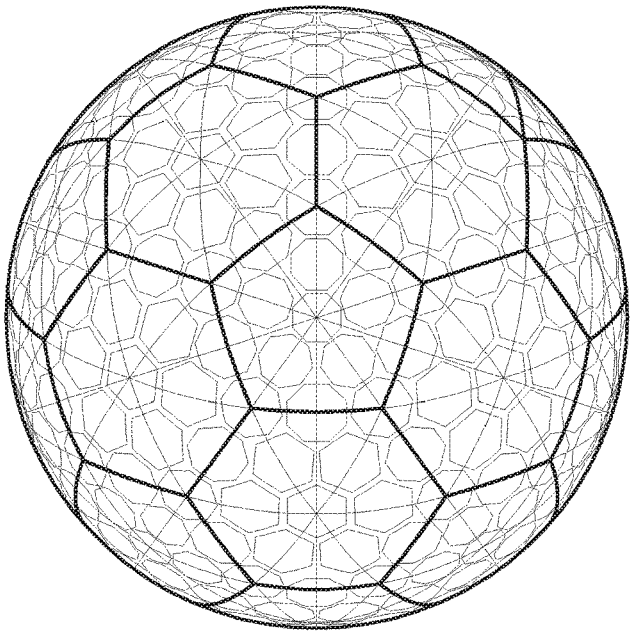
FIG. 8 shows a golf ball with polygonal dimples.

FIG. 6 shows spherical hexagons that share one side with the spherical regular pentagon having the pole at the center thereof. A representative spherical hexagon has, as sides, line segments that connect the point 86 (latitude 46.64180242° and longitude 90°), the point 89 (latitude 69.92324873° and longitude 90°), the point 90 (latitude 69.92324873° and longitude 18°), the point 85 (latitude 46.64180242° and longitude 18°), the point 84 (latitude 30.99196881° and longitude 40.38617757°), the point 82 (latitude 30.99196881° and longitude 67.61382243°), and the point 86 (latitude 46.64180242° and longitude 90°). The internal angle R of a vertex at which the side near the pole is shared by the spherical hexagon and the spherical pentagon is 124.3093605 degrees, and internal angles, which face each other and are formed on the same side based on a line segment dividing the spherical hexagon in half from the pole to the equator, are the same as each other. Also, the internal angle S of another vertex of the spherical hexagon is 124.3093605 degrees, and an internal angle of a vertex which faces the above vertex is the same as above. The internal angle T of a vertex of a side of the spherical hexagon which is near the equator is 124.3093605 degrees, and internal angles, which face each other and are formed on the same side based on the line segment dividing the spherical hexagon in half from the pole to the equator, are the same as each other. Therefore, the spherical hexagon has equal internal angles.

When the circumference of the sphere is 360 degrees, each length of the side and the height is represented as an angular length as follows. The length q of a topside of the spherical hexagon which is near the pole is an angular length of 23.28144627 degrees because the length q is the same as that of one side of the regular pentagon which is near the pole, and the length t of an upper side connected to the topside is an angular length of 23.28144627 degrees. A side, which is opposite to the upper side on the same location based on the line segment dividing the spherical hexagon in half from the pole to the equator, has the same angular length. An internal angle of a vertex of a lower side connected to the upper side is the same as above, and sides, which face each other and are formed on the same side based on the line segment dividing the spherical hexagon in half from the pole to the equator, have the same angular length. The length y of a base side of the spherical hexagon is an angular length of 23.28144627 degrees. Therefore, the spherical hexagon is a spherical regular hexagon, and the height length w between the topside and the base side of the spherical regular hexagon is an angular length of 41.8103149 degrees. The length v of a line segment that connects the vertex, that is, the point 86 (latitude 46.64180242° and longitude 90°), to the vertex, that is, the point 85 (latitude 46.64180242° and longitude 18°), that is, the length v of the line segment perpendicular to the height, is an angular length of 47.6003652 degrees.

FIG. 5 shows spherical pentagons that share one side with the spherical hexagon and are near the equator. Among the spherical pentagons, a representative pentagon has, as sides, line segments that connect the point 87 (latitude 46.64180242° and longitude 162°), the point 79 (latitude 30.99196881° and longitude 139.61382243°), the point 76 (latitude 9.883145528° and longitude 150.18141426°), the point 74 (latitude 9.883145528° and longitude 173.8185857°), the point 78 (latitude 30.99196881° and longitude 184.3861776°), and the point 87 (latitude 46.64180242° and longitude 162°). The internal angle U of a vertex, at which one side is shared by the spherical pentagon and the spherical hexagon, is 111.3812791 degrees, and the internal angle V of a vertex formed by a roof side and a pillar side of the spherical pentagon which is near the equator is 111.3812791 degrees. Internal angles, which face each other on the same side based on a line segment dividing the spherical pentagon in half from the pole to the equator, are the same as each other. The internal angle W of a vertex formed by a pillar side and a base side of the spherical pentagon which is near the equator is 111.3812791 degrees. Internal angles, which face each other on the same side based on the line segment dividing the spherical pentagon in half from the pole to the equator, are the same as each other. Therefore, all internal angles are equal.

When the circumference of the sphere is 360 degrees, each length of the side and the height of the spherical pentagon near the equator is represented as an angular length as follows. The length x1 of a roof side of the spherical pentagon near the equator is the same as one side of the spherical hexagon and is an angular length of 23.28144627 degrees. A length of a roof side which faces the same side based on the line segment dividing the spherical pentagon in half from the pole to the equator is the same as the length x1. The length x2 of a pillar side connected to the roof side is an angular length of 23.18144627 degrees, and a length of a side which faces the above pillar side on the same side based on the line segment dividing the spherical pentagon in half from the pole to the equator is the same as the length x2. The length x3 of a base side of the spherical pentagon near the equator is an angular length of 23.18144627 degrees. Also, a height length of the spherical pentagon near the equator is an angular length of 36.54896197 degrees because the spherical pentagon near the pole is a spherical regular pentagon having equal internal angles and equal sides. In addition, a spherical hexagon on the equator has internal angles and sides that are the same as the internal angles and the sides of the above spherical regular hexagon.

A spherical truncated icosahedron, which is obtained by dividing a spherical icosahedral surface by great circles, is a spherical polyhedron including twelve spherical regular pentagons and twenty spherical regular hexagons. Therefore, the spherical truncated icosahedron is greatly different from the spherical polyhedron of FIG. 3. As a comparative example of FIG. 5, FIG. 6 shows arrangement of dimples that revealed a lot of land surface LS on which the dimples are not arranged. As a result, a dimple area ratio is reduced, and thus, a lift force of the golf ball may be degraded. On the golf ball 100 of FIG. 1, the spherical polygons, which are near the equator from among the spherical polygons that are formed by dividing the surface of the sphere by the small circles, are further divided by the great circles, and the dimples are actually arranged on the spherical polygons. In comparison with the golf ball 200 of FIG. 6 that is a comparative example, the golf ball 100 has much smaller land surfaces LS. The golf ball 100 has the dimple area ratio that is 3 to 4% higher than that of the golf ball 200 on which the dimples are arranged on the surface divided by the great circles.

In Table 1 below, areas of the spherical polygons of the spherical polyhedron that are obtained by dividing the surface of the sphere by the small circles as in the golf ball 100 of FIG. 1 are compared with areas of the spherical polygons of the spherical truncated icosahedron that are obtained by dividing the surface of the sphere by the great circles as in the golf ball 200 of FIG. 5. In Table 1, both areas correspond to areas in mold cavities for manufacturing a golf ball, and diameters of the mold cavities are all 4.285 cm, and total surface areas are all 57.68348957 $cm^2$.

TABLE 1

| Name of spherical polygon | Classification | Area ($cm^2$) | Number | Total area ($cm^2$) |
|---|---|---|---|---|
| Spherical pentagon near the pole | Division by small circles | 1.536155434 | 2 | 3.07231087 |
| | Division by great circles | 1.354472055 | 2 | 2.70894411 |
| Spherical hexagon near the pole | Division by small circles | 2.226907038 | 10 | 22.2690704 |
| | Division by great circles | 2.071491246 | 10 | 20.71491246 |
| Spherical pentagon near the equator | Division by small circles | 1.780250881 | 10 | 17.80250881 |
| | Division by great circles | 1.354472055 | 10 | 13.54472055 |
| Spherical trapezoid | Division by small circles | 1.453959951 | 10 | 14.53959951 |
| Spherical hexagon near the equator | Division by great circles | 2.071491246 | 10 | 20.71491246 |
| Total area | Division by small circles | Total surface area 57.68348957 ($cm^2$) | | |
| | Division by great circles | Total surface area 57.68348957 ($cm^2$) | | |

As shown in Table 1, it is greatly important to make each spherical polygon, on which the dimples are to be arranged, have a proper size, and in the case of the surface of the sphere that is divided by the small circles, a dimple area ratio may effectively increase, and thus, a golf ball may have improved flight performance.

FIG. 4 shows a golf ball 102 according to another exemplary embodiment. Referring to FIG. 4, a surface of the golf ball 102, on which the dimples are arranged, is observed at the pole P. Upon comparing the golf ball 102 with the golf ball 100, spherical polygons of the golf ball 102 which are near the equator are not further divided by great circles. That is, after the surface of the sphere is divided by line segments of small circles, the spherical polygons are symmetrically determined, and then dimples are arranged on the spherical polygons.

The golf ball 102 may have a land surface which is relatively smaller than that of an existing golf ball and may also have an increased dimple area ratio.

According to the one or more exemplary embodiments, in comparison with an existing golf ball that is generated by arranging dimples on a spherical polyhedron obtained by dividing a surface of a sphere by great circles, a golf ball has a reduced land surface and an increased dimple area ratio as dimples are arranged on a spherical polyhedron that is obtained by dividing a surface of a sphere by small circles. Accordingly, a flight distance of the golf ball may increase.

Also, when the dimples are arranged on a spherical polyhedron that is generated by further dividing spherical polygons which are near the equator from among spherical polygons that are generated by dividing the surface of the sphere by the small circles, the golf ball may have a greater dimple area ratio than the existing golf ball, and thus, the flight distance of the golf ball may additionally increase.

It should be understood that exemplary embodiments described herein should be considered in a descriptive sense only and not for purposes of limitation. Descriptions of features or aspects within each exemplary embodiment should typically be considered as available for other similar features or aspects in other exemplary embodiments.

While one or more exemplary embodiments have been described with reference to the figures, it will be understood by those of ordinary skill in the art that various changes in form and details may be made therein without departing from the spirit and scope of the inventive concept as defined by the following claims.

What is claimed is:

1. A golf ball comprising a surface divided by imaginary small circles, wherein when an arbitrary point is considered as a pole, a plurality of dimples are arranged on spherical polygons obtained by dividing the surface of the golf ball by the imaginary small circles, the plurality of dimples being arranged such that each of the plurality of dimples is circular, and each dimple is bisected by at least one of the small circles, the imaginary small circles comprising:

a small circle passing through a point 1 (latitude 0°, longitude 5.80973032°), a point 45 (latitude 28.35345483°, longitude 355.32848°), a point 55 (latitude 50.83302265°, longitude) 342°, a point 60 (latitude 68.95139°, longitude 306°), a point 59 (latitude 68.95139°, longitude) 234°, a point 53 (latitude 50.83302265°, longitude 198°), a point 37 (latitude 28.35345483°, longitude 184.67152°), and a point 15 (latitude 0°, longitude 174.1902697°);

a small circle passing through a point 3 (latitude 0°, longitude 30.1902696°), a point 31 (latitude 28.35345483°, longitude 40.67152°), a point 51 (latitude 50.83302265°, longitude 54°), a point 57 (latitude 68.95139°, longitude 90°), a point 58 (latitude 68.95139°, longitude 162°), the point 53 (latitude 50.83302265°, longitude 198°), a point 39 (latitude 28.35345483°, longitude 211.32848°), and a point 19 (latitude 0°, longitude 221.8097303°);

a small circle passing through a point 7 (latitude 0°, longitude 77.80973032°), a point 33 (latitude 28.35345483°, longitude 67.32848°), the point 51 (latitude 50.83302265°, longitude) 54°, a point 56 (latitude 68.95139°, longitude 18°), the point 60 (latitude 68.95139°, longitude) 306°, a point 54 (latitude 50.83302265°, longitude 270°), a point 40 (latitude 28.35345483°, longitude 256.67152°), and a point 21 (latitude 0°, longitude 246.1902697°);

a small circle passing through a point 9 (latitude 0°, longitude 102.1902697°), a point 34 (latitude 28.35345483°, longitude 112.67152°), a point 52 (latitude 50.83302265°, longitude) 126°, the point 58 (latitude 68.95139°, longitude 162°), the point 59 (latitude 68.95139°, longitude 234°), the point 54 (latitude 50.83302265°, longitude 270°), a point 42 (latitude 28.35345483°, longitude 283.32848°), and a point 25 (latitude 0°, longitude 293.8097303°);

a small circle passing through a point 13 (latitude 0°, longitude 149.8097303°), a point 36 (latitude 28.35345483°, longitude 139.32848°), the point 52 (latitude 50.83302265°, longitude) 126°, the point 57 (latitude 68.95139°, longitude 90°), the point 56 (latitude 68.95139°, longitude 18°), the point 55 (latitude 50.83302265°, longitude 342°), a point 43 (latitude 28.35345483°, longitude 328.67152°), and a point 27 (latitude 0°, longitude 318.1902697°);

a small circle passing through a point 5 (latitude 0°, longitude 54°), the point 33 (latitude 28.35345483°, longitude 67.32848°), a point 47 (latitude 44.80225°, longitude 90°), the point 52 (latitude 50.83302265°, longitude 126°), a point 48 (latitude 44.80225°, longitude 162°), the point 37 (latitude 28.35345483°, longitude 184.67152°), and a point 17 (latitude 0°, longitude) 198°;

a small circle passing through the point 5 (latitude 0°, longitude 54°), the point 31 (latitude 28.35345483°, longitude 40.67152°), a point 46 (latitude 44.80225°, longitude 18°), the point 55 (latitude 50.83302265°, longitude 342°), a point 50 (latitude 44.80225°, longitude) 306°, the point 42 (latitude 28.35345483°, longitude 283.32848°), and a point 23 (latitude 0°, longitude 270°);

a small circle passing through a point 11 (latitude 0°, longitude 126°), the point 36 (latitude 28.35345483°, longitude 139.32848°), the point 48 (latitude 44.80225°, longitude) 162°, the point 53 (latitude 50.83302265°, longitude 198°), a point 49 (latitude 44.80225°, longitude 234°), the point 40 (latitude 28.35345483°, longitude 256.67152°), and the point 23 (latitude 0°, longitude 270°);

a small circle pass the point 11 (latitude 0°, longitude 126°), the point 34 (latitude 28.35345483°, longitude 112.67152°), the point 47 (latitude 44.80225°, longitude 90°), the point 51 (latitude 50.83302265°, longitude 54°), the point 46 (latitude 44.80225°, longitude 18°), the point 45 (latitude 28.35345483°, longitude 355.32848°), and a point 29 (latitude 0°, longitude) 342°; and a small circle passing through the point 17 (latitude 0°, longitude 198°), the point 39 (latitude 28.35345483°, longitude 211.32848°), the point 49 (latitude 44.80225°, longitude) 234°, the point 54 (latitude 50.83302265°, longitude 270°), the point 50 (latitude 44.80225°, longitude 306°), the point 43 (latitude 28.35345483°, longitude 328.67152°), and the point 29 (latitude 0°, longitude 342°), wherein the spherical polygons, obtained by dividing the surface of the golf ball by the small circles, are further divided by:

an imaginary line segment of a great circle passing through a point 4 (latitude 0°, longitude 36°), a point 35 (latitude 29.012167742°, longitude 126°), and a point 18 (latitude 0°, longitude 216°);

an imaginary line segment of a great circle passing through a point 12 (latitude 0°, longitude 144°), a point 32 (latitude 29.012167742°, longitude 54°), and a point 28 (latitude 0°, longitude 324°);

an imaginary line segment of a great circle passing through a point 10 (latitude 0°, longitude 108°), a point 38 (latitude 29.012167742°, longitude 198°), and a point 24 (latitude 0°, longitude 288°);

an imaginary line segment of a great circle passing through a point 16 (latitude 0°, longitude 180°), a point 41 (latitude 29.012167742°, longitude 270°), and a point 30 (latitude 0°, longitude 0°); and an imaginary line segment of a great circle passing through a point 22 (latitude 0°, longitude 252°), a point 44 (latitude 29.012167742°, longitude 342°), and a point 6 (latitude 0°, longitude 72°), wherein the surface of the golf ball is divided by a great circle passing through a point 2 (latitude 0°, longitude 18°), a point 8 (latitude 0°, longitude 90°), a point 14 (latitude 0°, longitude 162°), a point 20 (latitude 0°, longitude 234°), and a point 26 (latitude 0°, longitude) 306°, wherein, the great circle is used as an equator, wherein the surface of the sphere comprises two imaginary spherical regular pentagons having poles at a center of the two imaginary spherical regular pentagons, ten imaginary spherical hexagons, ten imaginary spherical pentagons near the equator, and ten imaginary spherical trapezoids near the equator, and the dimples are arranged on the spherical regular pentagons, the spherical hexagons, the spherical pentagons, and the spherical trapezoids.

2. The golf ball of claim 1, wherein the dimples arranged have 2 to 8 kinds of diameter.

3. The golf ball of claim 1, wherein each of the vertices of the imaginary pentagons, hexagons, and trapezoids correspond to a center of a dimple in the dimples on the golf ball.

4. The golf call of claim 1, wherein the shapes and the small circles either symmetrically divide dimples or do not touch the dimples on the golf ball.

* * * * *